US006817295B2

(12) United States Patent
Metzler

(10) Patent No.: US 6,817,295 B2
(45) Date of Patent: Nov. 16, 2004

(54) METHOD AND ILLUSTRATION DEVICE FOR REGISTER MARK SETTING

(75) Inventor: Patrick Metzler, St. Wendel (DE)

(73) Assignee: NexPress Solutions LLC, Rochester, NY (US)

( * ) Notice: Subject to any disclaimer, the term of this patent is extended or adjusted under 35 U.S.C. 154(b) by 25 days.

(21) Appl. No.: 10/207,501

(22) Filed: Jul. 29, 2002

(65) Prior Publication Data

US 2003/0029341 A1 Feb. 13, 2003

(30) Foreign Application Priority Data

Aug. 9, 2001 (DE) ..... 101 39 310

(51) Int. Cl.[7] ..... B41F 33/00; B41J 2/525
(52) U.S. Cl. ..... 101/486; 101/483; 101/485
(58) Field of Search ..... 101/483, 485, 101/486; 347/116

(56) References Cited

U.S. PATENT DOCUMENTS 5,287,162 A * 2/1994 de Jong et al. ..... 399/49
5,806,430 A * 9/1998 Rodi ..... 101/484
5,974,967 A 11/1999 Bravenec et al. ..... 101/211
6,304,825 B1 * 10/2001 Nowak et al. ..... 702/94

FOREIGN PATENT DOCUMENTS

EP 1157 837 A2 11/2001 ..... B41F/33/00
JP 2001083762 A * 3/2001 ..... G03G/15/01

OTHER PUBLICATIONS

International Search Report.

* cited by examiner

*Primary Examiner*—Daniel J. Colilla
(74) *Attorney, Agent, or Firm*—Lawrence P. Kessler

(57) ABSTRACT

A method and device for register mark setting of a printing press for multicolor printing. A calibration run is used for the calibration of register frames, and the correction data produced by the calibration of the frame is used to calibrate the register mark keeping of individual lines or areas of lines from the printing modules of the printing press, whereby the data of the register marks are detected to determine the correction data and are set in relationship to positions of an illustration drum and/or a separation drum.

3 Claims, 6 Drawing Sheets

METHOD AND ILLUSTRATION DEVICE FOR REGISTER MARK SETTING

FIELD OF THE INVENTION

The invention is related to a method and illustration device for the register mark setting for printing presses for multicolor printing.

BACKGROUND OF THE INVENTION

With multicolor printing in the printing industry, individual successive printing modules in the printing press are used to generate various color separations. In the printing modules, the generated color separations are applied successively on print stock and, after having been printed on top of one another, produce the ultimate colored print image. In order to guarantee a precisely superposed printing or superposition of the color separations and a flawless print image, register marks (which are also referred to as registers for multicolor printing) are printed on print stock or conveyor belt or web during calibration runs for preparation of the actual printing process. During the calibration runs a number of register marks are applied to the web, for example, and subsequently, the proper positioning of these register marks is checked. Sometimes pulse counters are used to control the points in time, at which the register marks are applied to the web by a printing drum or a sub-carrier, or by a rubber-covered drum between the printing drum and the print stock. In a particular concept that uses calibration runs, first the registration marks are established with a first calibration run that sets the distances between the frames. Thereafter a second calibration run establishes the distances between the individual register marks of a single large frame, as well as the same color separations from one another, e.g., the distance of the register mark for magenta of a large frame to the subsequent register mark for magenta.

Frames of register marks are composed of a defined constant number of several individual register marks for individual color separations printed close together. There is a given distance between the frames of the register marks; often with the first calibration run, a frame is used for every simulated sheet of a stock. In contrast to the above-mentioned, a large frame contains all the register marks of the calibration run and has a precise beginning and end. A pulse counter generates the printing on the web during the calibration at the appropriate time, so that the register marks are applied to the web in time. The register marks are applied at similar distances, which are determined by a given number of pulses per time in relationship to the speed, which occurs during the printing of the web with register marks according to the emission of a triggering signal. This speed is basically determined according to the speed of the motor-driven web and by the friction driven related printing drum and the sub-carrier or separation drum. The individual register marks are thus applied to the web with constant pulses. The term "line" is defined by an arranged series of pixels that are transverse to the described surface, stock or web; the term "area" defines a plurality of lines. In the subsequent printing, the shifting of the register marks leads to shifts of the superposed color separations.

This concept is used for a printing press to provide a perfect distance between the frames of register marks within a tolerance, from which flawless beginnings of images of the individual color separations follow. Also, its purpose is to provide flawless distances between the register marks of the same color on the web, with which color shifts of areas or lines within the print image are prevented. To fulfill both requirements, as described, two individual calibration runs are required, with the first calibration run for calibrating the frames and a second calibration run for calibrating the individual register marks of the same color. Furthermore, there is a problem that the longer the calibration process lasts, the greater the effect of other errors, i.e., the effectiveness of the calibration process is reduced.

SUMMARY OF THE INVENTION

In view of the above, it is the purpose of this of the invention to provide registerability with a single calibration run. The invention advantageously solves the task by using a calibration run to calibrate a register frame and the correction data produced is used to calibrate the registerability of individual areas or individual lines of color separations from printing modules of the printing press, whereby the data of the register marks are detected to determine the correction data and are set in relationship to positions of an illustration drum and/or of a separation drum of said printing press.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
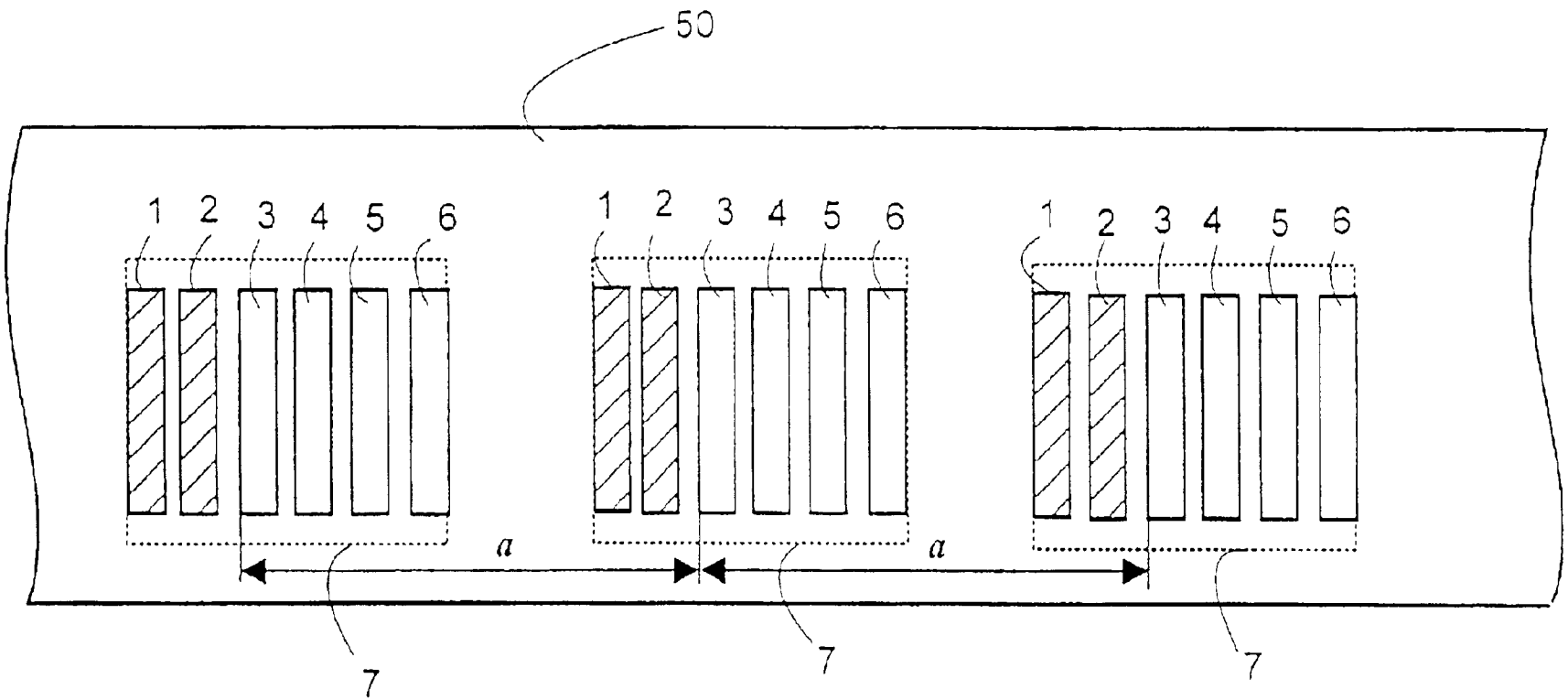
FIG. 1 shows, as an example, three successive flawless frames of register marks.

Referring now to the accompanying drawings, FIG. 1 shows a pattern of register frames 7 for calibration purposes on a conveyor belt or web 50. The patterns include two calibration marks 1, 2 and four register marks 3, 4, 5, 6, which are each assigned a color in multiple color printing. FIG. 1 shows flawless frames 7, in which the distances a of the individual register marks 3, 4, 5, 6 to the next frame 7 are constant. FIG. 1 shows only one frame 7 for each arrangement of two calibration marks 1, 2 and register marks 3, 4, 5, 6. Actually, each register mark 3, 4, 5, 6 is assigned one frame 7. The arrangement according to FIG. 1 guarantees the registerability on the printing following the calibration; the printing starts at the desired start position and the color separations are precisely superposed, in order to obtain the desired print image.

Figure 2:
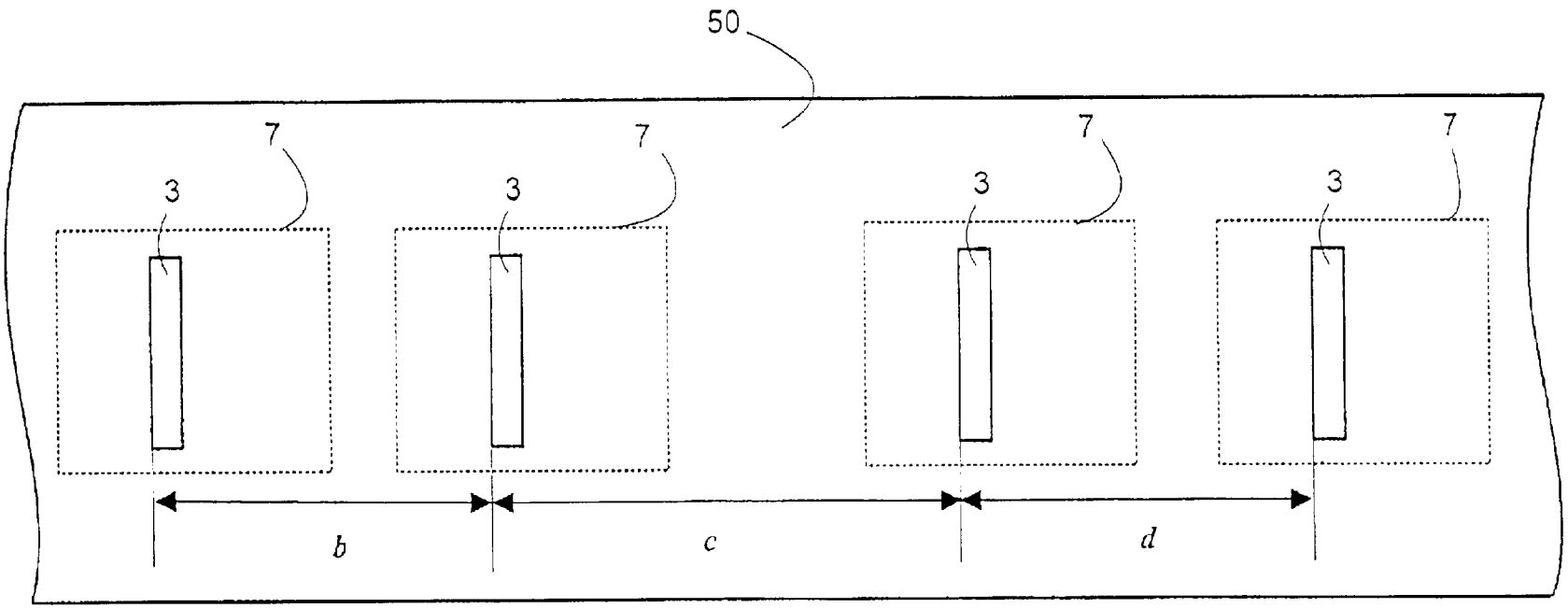
FIG. 2 shows shifts between the frames, which are, for example, represented by a single register mark.

FIG. 2 shows only one register mark 3, for example, according to FIG. 1 for reasons of clarity; the remaining register marks 4, 5, 6 may, of course, have been illustrated in the same manner. FIG. 2 shows shifts between the frames 7 on the web 50; the distances b, c, d of the register marks 3 of the frames 7 are not balanced with one another and are not balanced with distance a according to FIG. 1. The result of the register arrangement according to FIG. 2 is that, with the printing following the calibration process described herein, the print image of a color separation is applied to the print stock too soon or too late, and consequently leads to shifts between the respective color separations of the print image on the print stock. The color separations are undesirably lying or standing so that they are not registerable in the superposed position.

Figure 3:
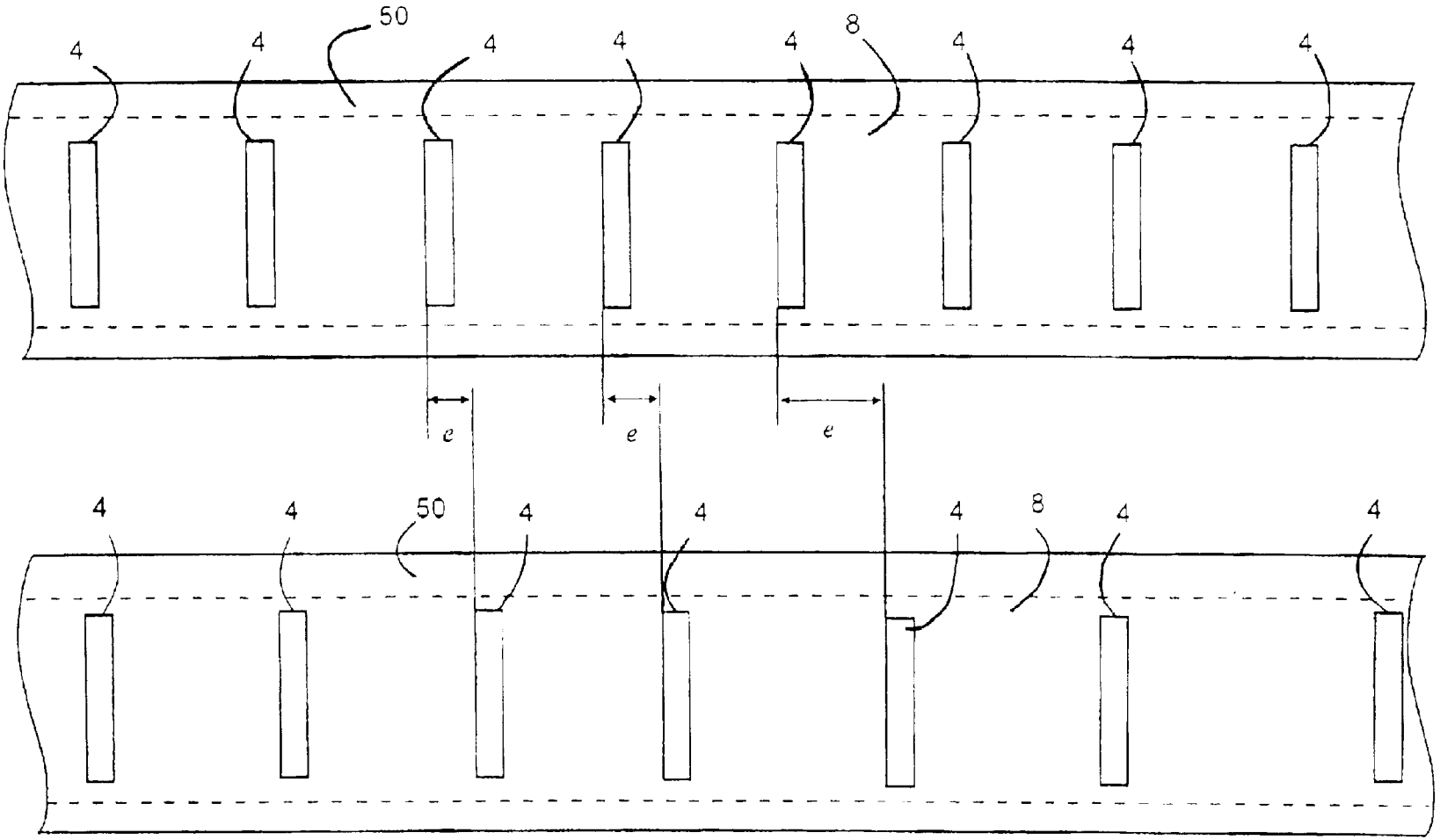
FIG. 3 shows, with the help of the flawless illustration of the upper drawing, in the lower drawing, shifts between the individual register marks within a large frame, whose edges are outside the illustration area.

In contrast to FIG. 2, FIG. 3 shows a section of a large frame 8 on the web 50, whereby, in the lower drawing, the distances of a single register mark 4 of the same color, which are repeated at certain distances on the web 50, have changed in comparison to the corresponding positions of register mark 4 in the upper flawless drawing. The change of the distances or shifts is designated with the variable distance e. Similar to the register mark 4, the remaining register marks 3, 5, 6, which are not illustrated in FIG. 3, may also shift. Care must be taken that no simulation of a customary sheet is used in FIG. 3, because with this calibration process, a very long paper sheet is simulated on the web 50 with a single large frame 8 (only partially illustrated and which has a beginning and an end in the calibration run). The arrangement according to FIG. 3, leads to shifting of areas or lines of the color separations in the printing following the calibration run described herein, and the print image that is composed from the color separations, exhibiting artifacts, such as, for example, becoming blurred in areas.

Figure 4:
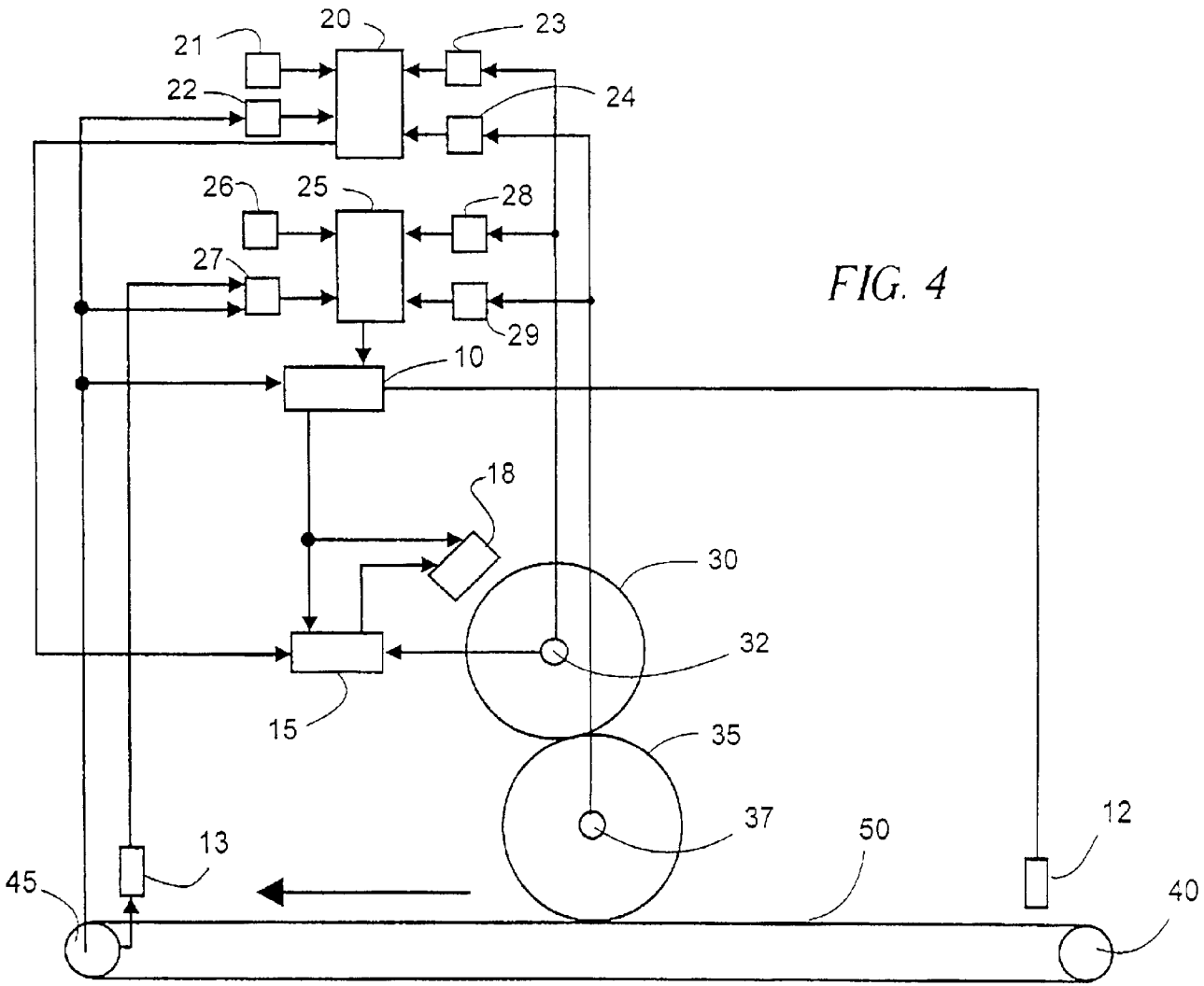
FIG. 4 shows a schematic drawing of part of a printing module of a printing press concerning the invention.

FIG. 4 shows a schematic drawing of part of a printing module of a printing press. In actuality there are a multiplicity of similar printing modules, aligned in sequence, in association with the conveyor belt or web 50. The modules are respectively dedicated to formation of individual respective color separation images. For the shown printing module, an illustration drum 30 is provided on which toner-filled images are positioned during the printing process. A separation drum 35, in association with the illustration drum 30, serves as the sub-carrier for transferring the toner-filled image from the illustration drum to a printable surface, i.e., the conveyor belt or web 50, or print stock. Furthermore, in front of the first of the printing modules, in the direction of travel of the web 50, a sensor 12 is provided close to the web 50 for emitting a signal, which identifies the detection of the leading edge of a sheet of print stock in the printing step following the calibration process described herein.

The sensor 12 is connected to a pulse counter 10. The pulse counter 10 is also connected to a rotary encoder 45, which detects the position of the web 50. Further, the sensor 12 is associated with a first register 25 and pulse divider 15. The rotary encoder 45 transmits signals to the pulse counter 10, to a first feedback circuit 27, and to a second feedback circuit 22. An encoder 32 on the illustration drum 30 is connected to the pulse divider 15, to a first correcting element 23, and to a second correcting element 28. An encoder 37 on the separation drum 35 is connected to a third correcting element 23 and to a fourth correcting element 29. A register mark sensor 13 behind the last of the printing modules, in the direction of travel of the web 50, detects the register marks 3, 4, 5, 6 applied by the printing modules. The register mark sensor 13 is connected to the first register 25 via the first feedback circuit 27.

A well-known marking device 18 is used to apply a toner-filled image to the illustration drum 30 and contains the necessary elements and devices (not shown) for this procedure. The marking device 18 is connected to the pulse divider 15 and to the pulse counter 10. Furthermore, a second register 20 transmits pulse-dividing cycles to the pulse divider 15. The other aligned sequential printing module devices are of similar construction and are not specifically illustrated or additionally described for clarity purposes. Accordingly, FIG. 4 shows only a single printing module for a single color, but it is understood that a respective single printing module is required for each color, whereby only a single sensor 12 in front of the printing modules is necessary. Such sensor 12 is then respectively connected to the pulse counter 10 of the individual printing module. Similarly, the single register sensor 13 is respectively connected to the pulse counter 10 of the individual printing modules, and is also respectively connected to the feedback circuits of the individual printing modules.

In the present case, when the printing press is operating in the preliminary run or in the calibration run, the marking device 18 applies the calibration marks 1, 2 and the register marks 3, 4, 5, 6 to the illustration drum 30 of the respective printing modules, whereby the four register marks 3, 4, 5, 6 and the two calibration marks 1, 2 are integrated into frames 7; each color of the register marks 3, 4, 5, 6 is applied by a respective printing module. The calibration marks 1, 2 are used for the register sensor 13, but are not required for understanding the invention. The register marks 3, 4, 5, 6 each identify a color, for example, key or black, cyan, magenta or yellow, and are consequently applied from one of four printing modules, respectively. The web 50 moves in the direction of the arrow, i.e., the top side of the web 50 moves from right to left in FIG. 4, and is driven by a suitable step motor (not shown). The illustration drum 30 and the separation drum 35 of the individual printing modules are driven by frictional engagement with the web 50.

The function of the illustration drum 30 (FIG. 4) is as follows: the sensor 12 transmits a signal to the pulse counter 10 via a connecting line. The signal is generated with the printing cycle following the described calibration process by detection of the leading edge of a sheet, and, in the calibration process described herein, the signal is independently produced by the presence of a sheet. After a given period of time, the pulse counter 10 produces a START OF FRAME signal, which is transmitted to the marking device 18, which in turn induces the illustration drum 30 to provide an image of a register mark 3, 4, 5, 6. The time that passes between the signal of the sensor 12, which indicates the detection of the leading edge of a printing stock sheet, and the application of the register marks 3, 4, 5, 6 to the illustration drum 30 by the marking device 18 and the transmission of the register marks 3, 4, 5, 6 via the separation drum 35 to the web 50 is ideally the exact same time it takes the web 50 to travel the path from below the sensor 12 to the nip of the separation drum 35 with the illustration of the register marks 3, 4, 5, 6 on the web 50.

During this procedure, it is assumed that there are no errors of the frames 7 (see FIG. 1); the frames are not at equal distances from one another, as illustrated by the distances a between the register marks 3. In the printing process of images on printing stock, which is carried out after the calibration run, flawless frames 7 guarantee a timely application of the beginnings of images, i.e., the shifting of a separation color in the direction of the sheet travel is prevented. FIG. 2 shows a case that indicates the shifting of the frames 7, and the distances b, c, and d from one frame 7 to the next are not in balance with a; the entire frame 7 has shifted in comparison to the adjacent frame 7. The explanation is that each register marks 3, 4, 5, 6 is assigned an individual frame 7, but in FIGS. 1 and 2, only a repeated frame 7 of one of the single register marks 3, 4, 5, 6 is illustrated. This means that each color has a frame 7, and that a START OF THE FRAME signal is produced for each color.

Without correction of the above-described shifts according to FIG. 2, the beginning of the images of the individual colors or color separations are shifted with the subsequent printing, and the areas or lines within the color separations lie or stand, however, basically correctly superposed. FIG. 3 illustrates various types of errors with register settings, which are appropriately calibrated in various ways. To date, customarily two calibration runs have been used for calibration of the described device, with the first calibration run being used to calibrate the errors of the frames 7 according to FIG. 2, and the second calibration run being used to calibrate the individual register marks 3, 4, 5, 6 of the same color with respect to one another according to FIG. 3, on a simulated large sheet that has a single large frame 8. By contrast, the invention uses only one calibration run, and for the purpose of clarity, initially two calibration runs are described below, before it is finally described in what way one calibration run instead of two is used.

The described two calibration runs correspond to a great extent to the sequence of operations in printing; in contrast to the printing process, data are detected during the calibration run and the first register 25 and the second register 20 are fed the data. With the subsequent printing, data are detected and compared with data of the first register 25 and the second register 20, and deviations are corrected. During a first calibration run, a number of individual sheets on the web 50 are simulated by the START OF FRAME signals of the sensor 12, and are printed on the individual register frames 7; with each START OF FRAME, a frame 7 is assigned to each register mark 3, 4, 5, 6, i.e., each register mark 3, 4, 5, 6 is assigned a START OF FRAME. The register sensor 13 detects the register marks 3, 4, 5, 6, and is connected to a rotary encoder 45 for detecting the position of the web 50. When the sensor 12 emits the START OF FRAME signal during the first calibration run, the position of the illustration drum 30 and the separation drum 35 are determined at this point in time by the first encoder 32 and the second encoder 37.

Based on the positions of the illustration drum 30 determined by encoder 32, position data are transmitted to the first correcting element 23 and to the second correcting element 28. The first correcting element 23 is assigned to the second register 20, and the second correcting element 28 is assigned to the register 25. In a similar manner, the second encoder 37 at the separation drum 35 detects the position of the separation drum 35 and transmits the position data to a third correcting element 24 and to a fourth correcting element 29. The third correcting element 24 is assigned to the second register 20, and the fourth correcting element 29 is assigned to the first register 25. The position data determined by the encoders 32, 37 each form a variable correcting component in contrast to each of the constant correcting component, and these variable correcting components are filed in the first constant memory 26 and in the second constant memory 21.

Correcting data are calculated from the variable and constant correcting components in the registers 20, 25, and are converted into pulses. Constant data from the first constant memory 26 are fed into the first register 25 as well as correcting data that are calculated in the second correcting element 28 and in the fourth correcting element 29 from the position data of the encoder 32 and 37. In addition, the first register 25 receives data from feedback element 27, which are based on signals transmitted from the register sensor 13 and the rotary encoder 45. The first register 25 calculates the correcting data from this data. The START OF FRAME signal is produced with the printing following the calibration run, in which the pulses assigned from the correcting data are fed to the pulse counter 10, from which the START OF FRAME signal for the beginning of a frame 7 is produced. The START OF FRAME signal is simulated during the first calibration run. The second calibration run is used to calibrate the individual register marks 3, 4, 5, 6 with respect to one another, i.e., register marks 3, 4, 5, 6 of the same color of a frame 8 according to FIG. 3.

In contrast to the frame 7, the term "large frame" 8 describes an arrangement of register marks 3, 4, 5, 6 that contains all the register marks 3, 4, 5, 6 and which has a single beginning and end. The distance of the same register marks 3, 4, 5, 6, e.g., cyan between the register mark cyan within a large frame 8 is also called magnification. For this purpose, a calibration run with a continuous sheet is simulated, i.e., in this case, no signal is produced by the sensor 12 for simulation of the leading edge of a sheet. After some time, the magnification is distorted by influences on the printing modules and the positions of the individual register marks 3, 4, 5, 6 change in relationship to one another, as illustrated in FIG. 3 between the upper and lower drawing, for example, by the error e.

In order to remedy the error, a second register 20 is ready, which, according to the above description, receives data from a second constant memory 22, which contains constant data without the effect of errors. A first correcting element 23 is ready to receive the position data from the first encoder 32, and a third correcting element 24, receives position data from the second encoder 37. The current positions in the shown embodiment concerning the segments of the illustration drum 30 and the separation drum 35 are observed in this manner. Furthermore, the second register 20 receives data from the rotary encoder 45 via a second feedback element 22. The data of the rotary encoder 45 describe the rotation of the rotary encoder 45 and consequently the travel of the web 50. In contrast to the first register 25 for correcting the frame 7, the second register 20 receives no data from the register sensor 13.

In the second register 20, the data received are submitted for calculations; inter alia, the position data of the first encoder 32 are compared with the data of the rotary encoder 45 to determine the shifting of the magnification. Such calculated data are assigned to a pulse number in a classification table or look-up table and stored. In addition, the pulse divider 15 receives the START OF FRAME signal. In the pulse divider 15, a START OF LINE signal is produced from the START OF FRAME signal and the signal from the second register 20, which generates the application of the register marks 3, 4, 5, 6 during the second calibration run. The START OF LINE signal is transmitted to the marking device 18 and causes the marking device 18 to apply a toner image to a line of the illustration drum 30, independently from the illustration data of the marking device 18. The following START OF LINE signal causes the next line to be marked on the illustration drum 30. This process is carried out for each register mark 3 through 6 in the individual printing modules, respectively. Furthermore, the application of the pulse divider 15 reduces errors of the illustration device. In the ideal case, when no shifting of the register marks 3, 4, 5, 6 with respect to each other occurs and the START OF LINE signal correctly takes place, a pattern is produced on the sheet corresponding to FIG. 1 or 2.

Figure 5:
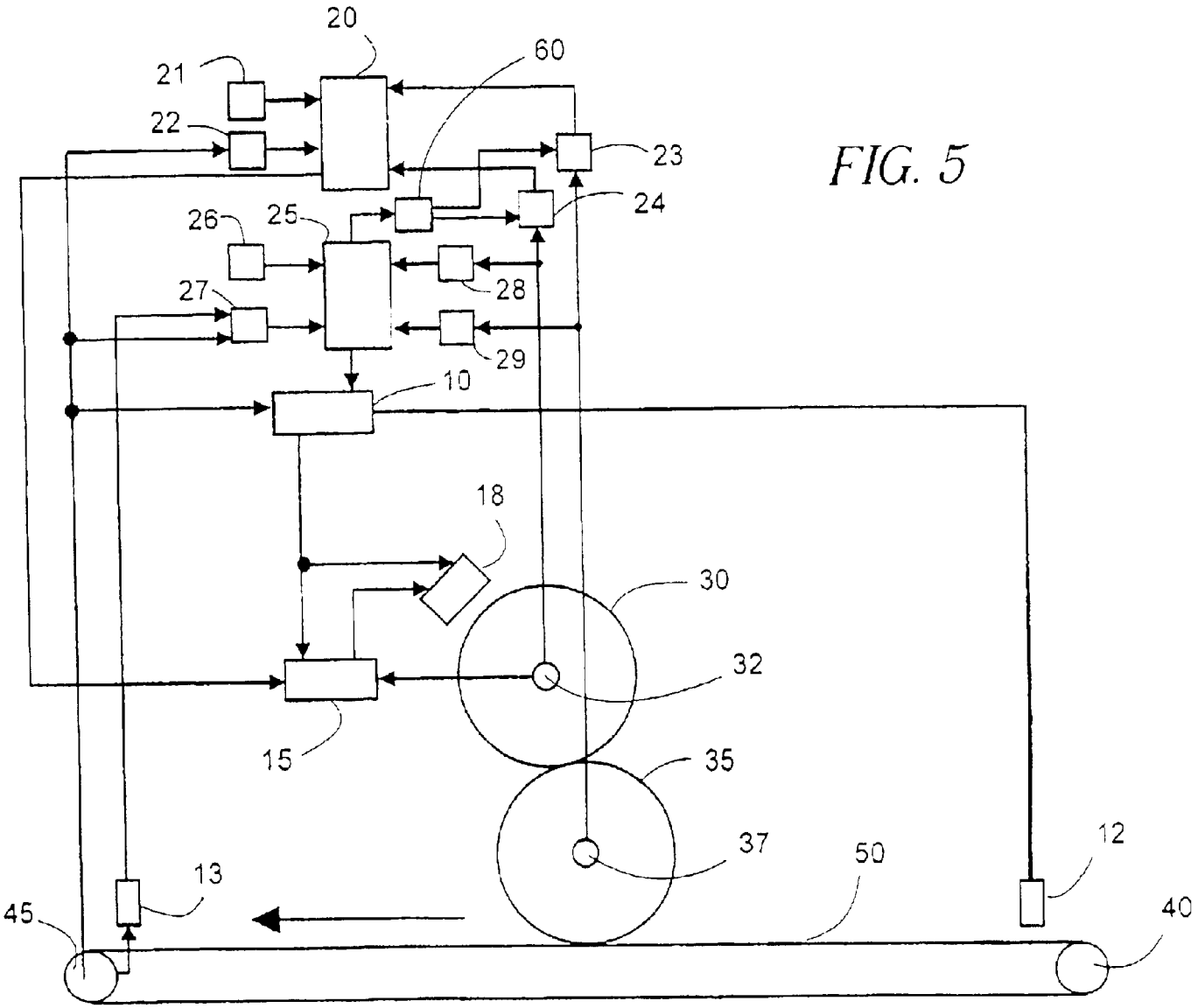
FIG. 5 shows a schematic drawing of part of a printing module of a printing press concerning the invention, with a computer for calculating the correction data for correcting the lines and areas based on the correction data of the frames.

The invention discloses replacing the two calibration runs described above with a single calibration run, so as to reduce the use of valuable machine running time and work against other errors. For this purpose, the first calibration run with the production of the START OF LINE signal, as described above, is carried out. The correction data of the first register 25 are converted in a suitable way in a computer 60 (as illustrated in FIG. 5), which are then used as correction data for the second register 20. Consequently, the second calibration run is dispensed with.

The conversion in the computer 60 is as follows: the position regarding a segment of the illustration drum 30 is determined at the point in time in which a given line with a given line number is produced on the illustration drum 30, advantageously with the START OF LINE signal. In addition, the position is determined in which the given line is detected by the register sensor 13. The data calculated in the computer 60, which are ultimately used to generate the START OF LINE signal, are the result of the difference of the position of the given line detected by the register sensor 12 and a predetermined position of the given line, which is calculated from the position of the illustration drum 30 during the marking of the given line on the web 50. The computer 60 transmits the calculated data to the first correcting element 23 and to the third correcting element 24, which calculates the correction data according to the above description, respectively, and transmits such correction data to the second register 20. The further process is described with relation to the description of FIG. 4. The second calibration run is dispensed with by the variants according to FIG. 5; that is; a single calibration run in which the illustration device simulates a sequence of successive sheets with a frame 7 per printing module or color, is sufficient to correct the errors described above. In addition, errors of the second calibration run are reduced with the help of these variants.

Figure 6:
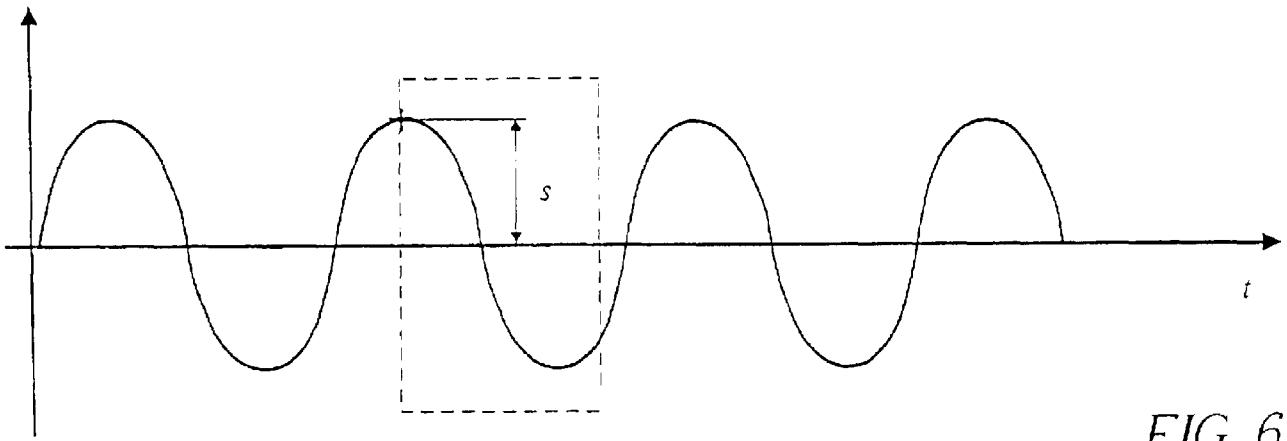
FIG. 6 shows an example of the periodic course of a START OF FRAME error.

Subsequently, the error course of the START OF FRAME errors is illustrated with and without other errors. FIG. 6 shows the periodic sinusoidal course of the START OF FRAME error as a function of the time t. The line segment s identifies the maximum errors of the START OF FRAME signal. As an illustration, a sheet of printing stock is shown with a dotted line. With this example, the START OF FRAME signal is emitted at the marking according to FIG. 6 on the left edge of the dotted sheet, and the error s hereby identifies the shifting of the frame of a complete color separation, and the corresponding color separation is shifted by the length s. The error of the START OF FRAME is determined during the calibration run as a function of the time and stored; with the printing following the calibration run, the error is corrected in the manner described above.

Figure 7:
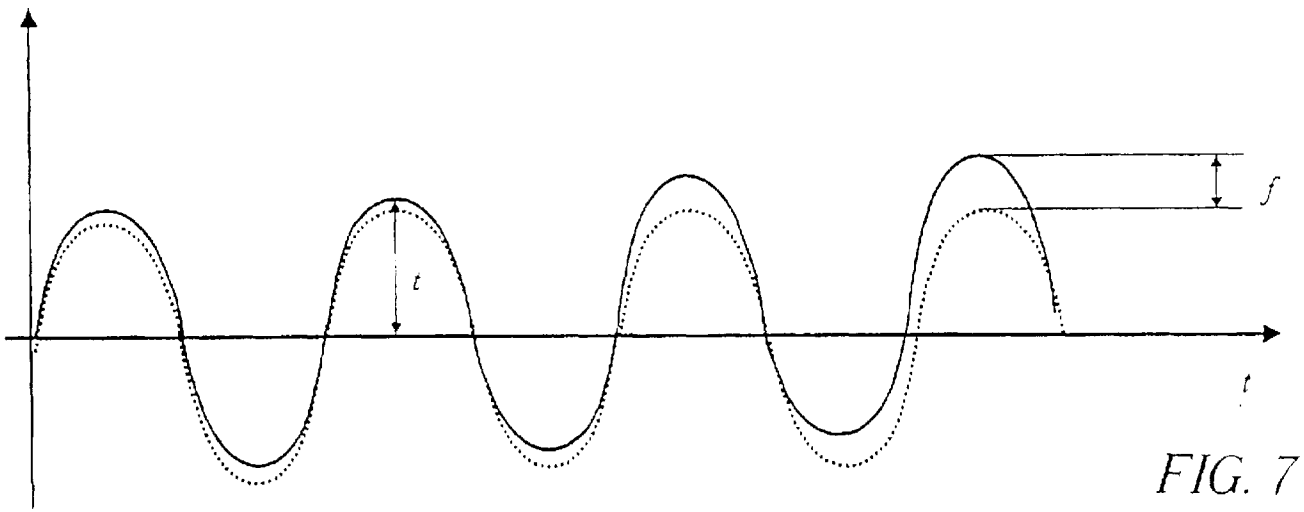
FIG. 7 shows the START OF FRAME error according to FIG. 6 with the run indicated by dotted lines according to FIG. 6 and a run with drift indicated by solid lines.

FIG. 7 shows the error course according to FIG. 6, whereby the error course is shown with a dotted line. The START OF FRAME signal is illustrated with solid lines as a further error with a drift effect. In contrast to the existing of the START OF FRAME, the drift error is designated with the length f; the length t identifies the added error of the START OF FRAME with the drift error, which increases in the course of time, as can be seen. The drift effect is perceptible after some runs of the printing press and leads to other errors in the following print image. Thus the drift effect does not occur immediately after several oscillations, as illustrated in FIG. 7, but only after some time, and the origin of the coordinate axis according to FIG. 7 is consequently time t is not equal to zero.

The drift during the original error curve of the START OF FRAME signal is independent of the latter and also of the START OF LINE signal. The method based on the invention serves to determine, and correct for, both types of errors, (the START OF FRAME error and the START OF LINE error), which distort the drift effect of the measurements and ultimately lead to defective correction data. When the drift effect is noticeable, the calibration run according to the invention has already been concluded, while the drift effect leads to errors in at least two individual calibrations during at least the second calibration run. The START OF LINE error behaves similar to FIGS. 6 and 7.

The invention has been described in detail with particular reference to certain preferred embodiments thereof, but it will be understood that variations and modifications can be effected within the spirit and scope of the invention.

What is claimed is:

1. Method for register mark setting during the calibration with a multicolor printing of a printing press having an illustration drum (30) and a separation drum (35), comprising: providing a single calibration run; using the single calibration run to calibrate a register frame; producing correction data; using the correction data to calibrate the registerability of individual areas or individual lines of color separations from printing modules of the printing press; whereby in producing correction data, data of register marks (3, 4, 5, 6) are detected to determine the correction data and are set in relationship to positions of the illustration drum (30) and/or of the separation drum (35) of said printing press.

2. Method according to claim 1, wherein production of register marks is controlled according to the correction data.

3. Method according to claim 2, wherein a triggering signal is transmitted to a pulse counter which in turn generates a register mark illustration signal due to a pulse, which is composed of a constant portion and a variable correction section, whereby said variable correction section is dependent upon the position of the illustration drum (30) and/or the separation drum (35).

* * * * *